United States Patent [19]

Minakuchi

[11] Patent Number: 4,519,333

[45] Date of Patent: May 28, 1985

[54] AUXILIARY PRESSER FOOT FOR ENGAGING A PREVIOUSLY FORMED STITCH

[75] Inventor: Fumio Minakuchi, Aichi, Japan

[73] Assignee: Aisin Seiki Kabushiki Kaisha, Japan

[21] Appl. No.: 457,603

[22] Filed: Jan. 13, 1983

[30] Foreign Application Priority Data

Jan. 13, 1982 [JP] Japan ..... 57-003888

[51] Int. Cl.[3] ..... D05B 27/04

[52] U.S. Cl. ..... 112/311; 112/320

[58] Field of Search ..... 112/311, 320, 235, 236, 112/240

[56] References Cited

U.S. PATENT DOCUMENTS

| | | | |
|---|---|---|---|
| 1,017,164 | 2/1912 | Noble | 112/320 |
| 2,737,914 | 3/1956 | Hofgesang | 112/240 X |
| 3,556,028 | 1/1971 | Yoshikawa | 112/240 |
| 3,570,426 | 3/1971 | Kunes | 112/320 |
| 3,935,826 | 2/1976 | Nicolay et al. | 112/320 |
| 4,067,275 | 1/1978 | Willenbacher | 112/320 |
| 4,116,145 | 9/1978 | Nicolay | 112/320 |

FOREIGN PATENT DOCUMENTS

| | | | |
|---|---|---|---|
| 548188 | 10/1957 | Canada | 112/240 |

*Primary Examiner*—Werner H. Schroeder
*Assistant Examiner*—Andrew M. Falik
*Attorney, Agent, or Firm*—Sughrue, Mion, Zinn, Macpeak, and Seas

[57] ABSTRACT

An auxiliary presser foot mechanism is mounted in a sewing machine with the auxiliary presser foot member being biased onto one or more previously formed stitches so that the previously formed stitches will not be unduly tensioned by the operation of the thread takeup lever during the formation of the new stitch. A cam mechanism is provided for raising the auxiliary presser foot during the feeding of the workpiece and spring means are provided for pressing the auxiliary presser foot against the previously formed stitches when the sewing machine feed dog is lowered beneath the throat plate of the sewing machine.

4 Claims, 8 Drawing Figures

AUXILIARY PRESSER FOOT FOR ENGAGING A PREVIOUSLY FORMED STITCH

BACKGROUND OF THE INVENTION

The present invention is directed to an auxiliary presser foot mechanism for a sewing machine and more specifically to a cam operated auxiliary presser foot for pressing previously formed stitches against the throat plate during the tensioning of a new stitch to prevent puckering.

In a conventional sewing machine, the feed dog is projected slightly above the throat plate when the thread takeup lever is located at a position just before the top dead center position. At this time, a workpiece, including previously formed stitches is pressed onto the throat plate by the conventional presser foot. The force applied onto the workpiece from the presser foot is not concentrated on the previously formed stitches. Thus, previously formed stitches are subjected to excessive tension by the thread takeup lever during the formation of successive new stitches with the result that seam puckering or work shrinkage occurs upon completion of the sewing operation.

SUMMARY OF THE INVENTION

The present invention provides a new and improved auxiliary presser foot mechanism for a sewing machine which overcomes the aforementioned difficulties.

The present invention provides a new and improved auxiliary presser foot mechanism for a sewing machine comprising an auxliary presser bar is mounted in the frame of the sewing machine rearwardly of the main presser bar in the direction of feed of the workpiece for vertical reciprocating movement, an auxiliary presser foot secured to the lower end of said presser bar adapted to engage and press previously formed stitches against the throat plate of the sewing machine during tensioning of the newly formed stitch, biasing means for urging the auxiliary presser bar and the auxiliary presser foot in the downward direction and lifting means coupled to the drive means for lifting the auxiliary presser foot during the feeding of the work piece by a conventional feed dog mechanism. The main presser foot is provided with an aperture rearwardly of the stitch forming means of the sewing machine through which the auxiliary presser foot extends to engage the previously formed stitches in the workpiece. The auxiliary presser foot is adjustably mounted on the lower end of the auxiliary presser bar for adjustable movement in the direction of feed of the workpiece. The sewing machine drive mechanism includes a main sewing machine shaft which is adapted to be driven by a motor and the lifting means is comprised of an eccentric cam mounted on the shaft and lever means pivotally mounted in the frame in operative engagement with the eccentric cam and the auxiliary presser bar whereby the auxiliary presser bar and the auxiliary presser foot are raised and lowered in sychronism with the rotation of the shaft.

The foregoing and other objects, features and advantages of the invention will be apparent from the following more particular description of a preferred embodiment of the invention as illustrated in the accompanying drawings.

DETAILED DESCRIPTION OF A PREFERRED EMBODIMENT

Figure 1:
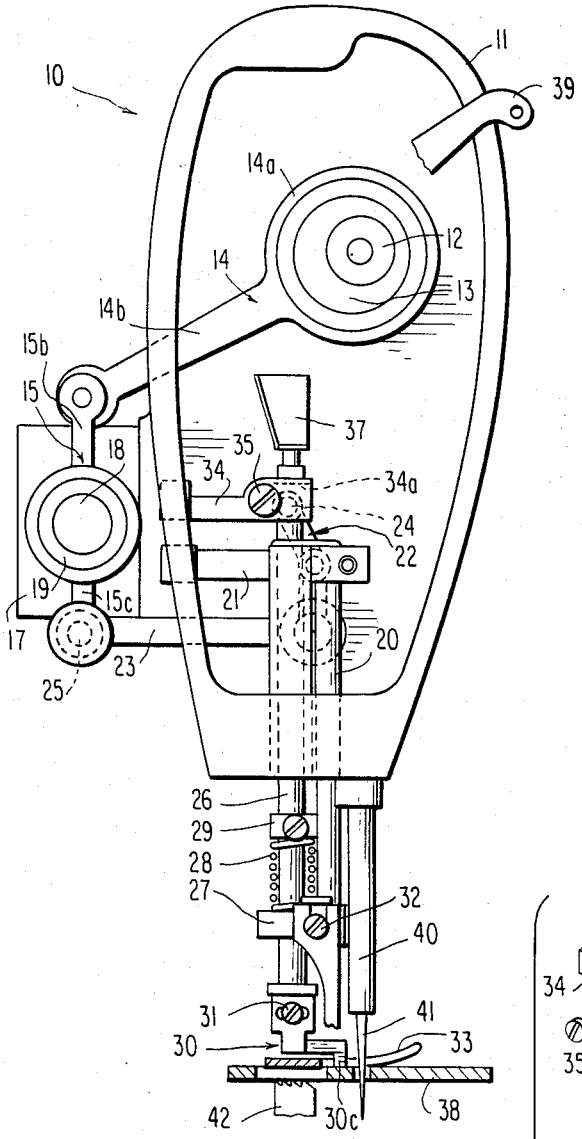
FIG. 1 is a cross-sectional view of a sewing machine having an auxiliary presser foot mechanism according to the present invention.
Figure 2:
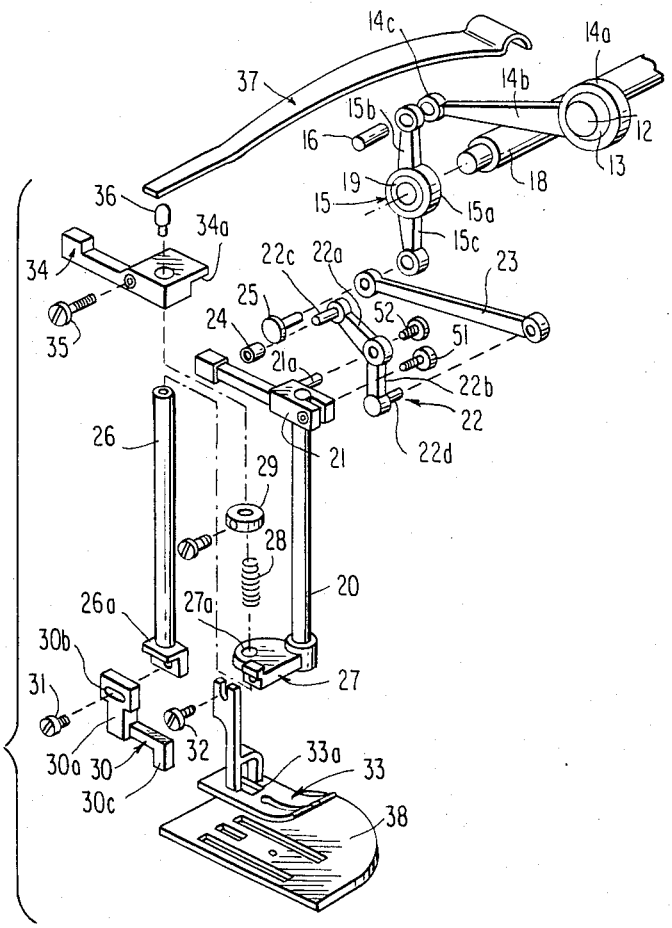
FIG. 2 is an exploded view of the auxiliary presser foot mechanism according to the present invention.
Figure 3:
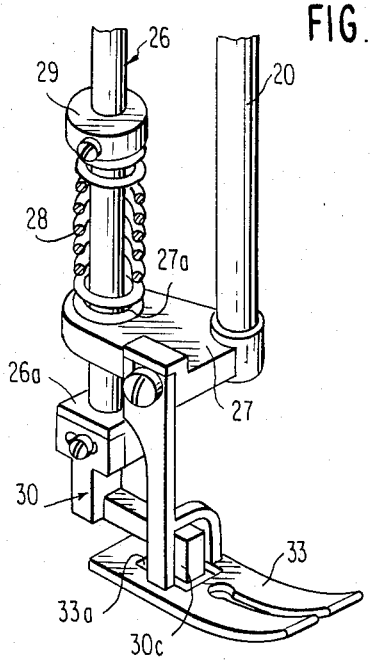
FIG. 3 is a perspective view of the auxiliary presser foot mechanism according to the present invention.

With reference to FIGS. 1–8, inclusive, a sewing machine 10 has a frame 11 in which a main shaft 12 is operatively disposed in the well known manner. An eccentric cam is mounted on the shaft 12 for rotation therewith. A transmitting member 14 is formed at the right end portion thereof as viewed in FIG. 1 with a portion 14*a* which encircles the eccentric cam 15. Thus, a straight or intermediate portion 14*b* of the member 14 is reciprocated back and forth in the longitudinal direction thereof. A shaft 18 is supported in a box 17 mounted on the rear side of the frame 11. A central cylindrical portion 15*a* of a swinging member 15 is mounted on the shaft 18 by means of a bearing 19. The swinging member 15 is provided with a pair of arms 15*b* and 15*c* which extend from the cylindrical portion 15*a* in opposite radial directions. The arm 15*b* of the member 15 is pivotally connected to the left end portion 14*c* of the transmitting member 14 by means of a pin 16 so that the arm 15*b* may be swung in accordance with the reciprocating straight line movement of the member 14.

A presser bar 20 is provided at the lower end portion thereof with a support member 27 to which a presser foot 33 is secured by screw means 32. A guide bracket 21 is secured to the upper end of the presser bar 20 by screw means 51. A tubular projection 21*a* extends from the guide bracket 21 and a second swinging member 22 is pivotally mounted thereon. The removal of the member 22 from the projection 21*a* is prevented by screw means 52. The swinging member 22 is provided with a pair of arms 22*a*, 22*b*, from which a pair of pins 22*c* 22*d* project in opposite directions. The pin 22*d* is pivotally connected to the right end portion of a rod 23 whose left end portion is pivotally connected to the arms 15*c* of the swinging member 15 by pin means 25. The pin 22*c* of the second swinging member 22 is provided with a roller 24.

The support member 27 is formed with a hole 27*a* through which an auxiliary presser bar 26 is passed. A lower end portion of the bar 26 is formed with a base portion 26*a* to which an auxiliary presser foot member is connected by screw means 31. The auxiliary presser foot member 30 has an upper portion 30*a* with a longitudinal slot 30*d* for adjusting or positioning the foot member 30 in the workpiece feed direction, and a lower portion 30*c* for urging the workpiece 50 onto a throat plate 38.

A retainer 29 is secured to an intermediate portion of the bar 26 and a coil spring 28 is located between the support member 27 and the retainer 29 so as to bias the auxiliary presser bar 26 in the upward direction. An upper end portion of the bar 26 is connected to a second bracket 34 by screw means 35. The bracket 34 is provided with an elastic retainer or a rubber member 36 through which the downward force exerted by the leaf spring 37 is applied to the bar 26 against the force of the spring 28. Thus, the lower portion 30*c* of the auxiliary presser foot member 30 is passed through a hole 33*a* in the presser foot 33 and is brought into engagement with the workpiece 50.

The bracket 34 has a sliding surface 34*a* disposed in opposing relation to the roller 24 so that upon raising of the roller 24, the roller 24 will engage the sliding surface 34*a* and move the bracket 34 and the presser bar 26 in the upward direction. The roller 24 and the lever upon which it is mounted are so designed that the roller 24 will be brought into engagement with the sliding surface 34*a* of the bracket 34 when the feed dog 42 begins to move or feed the workpiece 50 in cooperation with the presser foot 33 and is removed from the sliding surface 34*a* when the feed dog 42 begins to sink the throat plate 38. Thus, the auxiliary presser foot member 30 is in abutment with one or more already formed stitches 50*a* in the workpiece 50 when the feed dog 42 is positioned or located below the throat plate 38 and the thread takeup lever 39 is positioned just before the top dead center position. In other words, one or more already formed stitches 50*a* are biased in the downward direction by the auxiliary presser foot member 30 so that such stitches 50*a* will not be subjected to undue tension when the needle thread 60 is tensioned by the takeup lever 39 for forming a new stitch 50*b*. The numerals 40 and 41 denote the needle bar and the needle respectively.

The operation of the sewing machine as shown in FIGS. 4–7 will now be described in detail. As viewed in FIG. 4, the feed dog 42 is at its bottom dead center position, the thread takeup lever 39 is located just past its top dead center position and the auxiliary presser foot 30 is positioned above the throat plate 38. Upon clockwise rotation of the main shaft, the transmitting member 14 is moved to the right as viewed in FIG. 4 so that the arms 15*b* and 15*c* are rotated about the shaft 18 in the clockwise direction.

Figure 4:
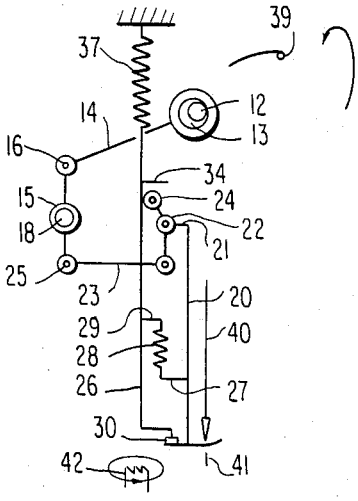
FIGS. 4–7, inclusive, are schematic views sequentially illustrating the operation of the auxiliary presser foot mechanism according to the present invention.
Figure 5:
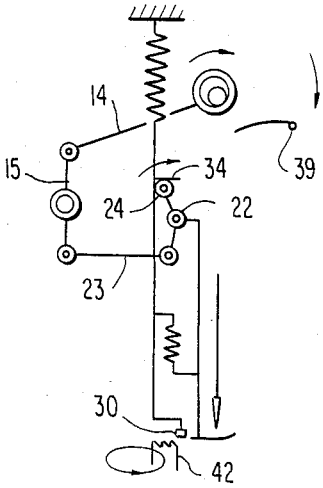

Due to the clockwise rotation of the arms 15*b* and 15*c* of the swinging member 15, the rod 23 is moved to the left as viewed in FIG. 4. The second swinging member 32 is then rotated in a clockwise direction so that the roller 24 is brought into engagement with the sliding surface 34*a* of the bracket 34. At this time the feed dog is moved in the counterclockwise direction as viewed in FIG. 5, the bar 26 is further moved in an upward direction, and the thread takeup lever 39 is moved in the downward direction so as to provide slack in the needle thread 60 to enable the needle thread loop to be passed about a shuttle (not shown).

Figure 6:
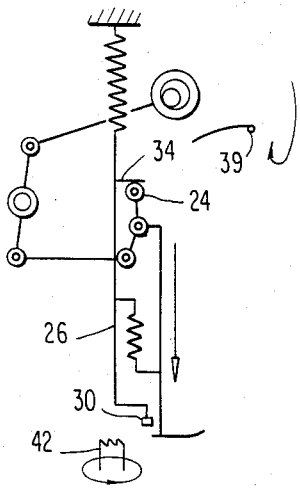

Upon further clockwise rotation of the main shaft 12, the roller 24 is also moved in the clockwise direction so that the bracket 34 is further moved in the upward direction against the leafspring 37 as viewed in FIG. 6. Thus, the bar 26 and the foot member 30 connected thereto are moved in the upward direction.

Figure 7:
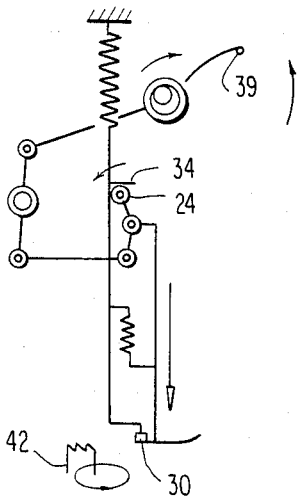

Upon still further clockwise rotation of the main shaft 12, the roller 24 is rotated in the counterclockwise direction as viewed in FIG. 7 and is removed from the sliding surface 34*a* of the bracket 34. Simultaneously the foot member and the feed dog 42 are respectively moved downwardly. At this time the thread takeup lever 39 is located at a point just before its top dead center position.

Figure 8:
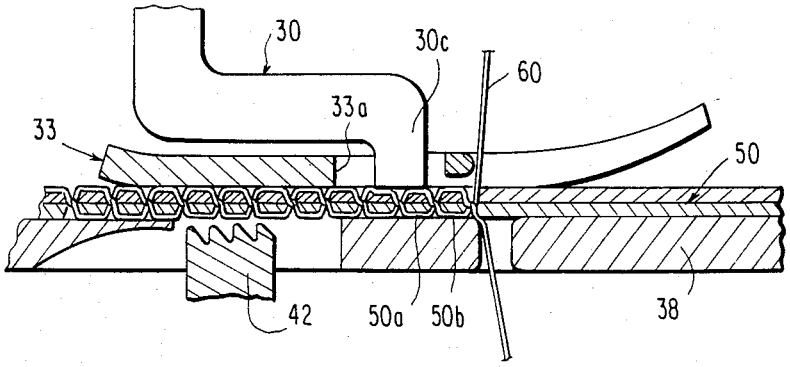
FIG. 8 is an enlarged detailed view of the auxiliary presser foot mechanism in relation to the stitches in the workpiece.

During the change from the condition shown in FIG. 7 to that shown in FIG. 4, the thread pickup lever 39 passes through its top dead center position so that the needle thread 60 is tensioned so as to form a new stitch 50*b* as best seen in FIG. 8. Also, during the aforementioned change in condition from FIG. 7 to FIG. 4, the foot member 30 is pressed onto one or more of the already formed stitches 50*a* as best seen in FIG. 8, so that the stitches 50*a* are not excessively tensioned by the thread takeup lever 39 during the subsequent formation of additional new stitches 50*b*.

While the invention has been particularly shown and described with reference to a preferred embodiment thereof, it will be understood by those in the art that various changes in form and detail may be made therein without departing from the spirit and scope of the invention.

What is claimed is:

1. In a sewing machine having a frame supporting stitch-forming means, a drive mechanism, an apertured throat plate, a presser bar mounted above said throat plate for vertical reciprocating movement only, a presser foot secured to lower end of said presser bar, a feed dog located below said throat plate adapted to be oscillated through said apertured throat plate by said drive mechanism for feeding a workpiece past said stitch-forming means and a needle-thread tensioning lever, the improvement comprising an auxiliary presser foot device comprising an auxiliary presser bar mounted in said frame rearwardly of said presser bar in the direction of feed of said workpiece for vertical reciprocating movement only, an auxiliary presser foot secured to lower end of said auxiliary presser bar adapted to engage and press previously formed stitches in said workpiece against said throat plate during tensioning of a newly formed stitch, biasing means for urging said auxiliarly presser bar and said auxiliary presser foot in the downward direction, and lifting means coupled to said drive means for lifting said auxiliary presser foot during feeding of said workpiece by said feed dog.

2. An auxiliary presser foot device as set forth in claim 1, wherein said presser foot is provided with an aperture rearwardly of said stitch forming means through which said auxiliary presser foot passes to engage the stitches in said workpiece.

3. An auxiliary presser foot device as set forth in claim 1, wherein said auxiliary presser foot is adjustably mounted on the lower end of said auxiliary presser bar for adjustable movement in the direction of feed of said workpiece.

4. An auxiliary presser foot device as set forth in claim 1 wherein said drive mechanism includes a main sewing machine shaft adapted to be driven by a motor and said lifting means is comprised of eccentric cam means mounted on said shaft and lever means pivotally mounted in said frame in operative engagement with said eccentric cam means and said auxiliary presser bar whereby said auxiliary presser bar and said auxiliary presser foot are raised and lowered in synchronism with the rotation of said shaft.

* * * * *